United States Patent [19]

Anderson

[11] 3,938,261

[45] Feb. 17, 1976

[54] APPARATUS FOR IMPROVING PRINTING SURFACE OF PRINTING MATERIAL

[76] Inventor: James K. Anderson, 1110 Rostrevor Circle, Louisville, Ky. 40205

[22] Filed: Feb. 27, 1974

[21] Appl. No.: 446,307

Related U.S. Application Data

[63] Continuation-in-part of Ser. No. 312,561, Dec. 6, 1972, Pat. No. 3,826,016.

[52] U.S. Cl. ..... 34/114; 34/119; 34/152; 34/155; 162/206; 162/207; 427/377

[51] Int. Cl.[2] ..... F26B 11/02

[58] Field of Search ..... 34/23, 113, 114, 110, 122, 34/124, 151–153, 155, 148, 119; 38/11, 44, 48, 49, 56, 57; 29/90.1, 90.2; 219/469–471, 388; 162/204, 206, 288, 207; 226/168, 196, 21, 189; 100/210, 93 RP; 427/377; 101/254

[56] References Cited

UNITED STATES PATENTS

| | | | |
|---|---|---|---|
| 693,189 | 2/1902 | Thomson | 427/377 |
| 1,087,938 | 2/1914 | Fourneaux | 427/377 |
| 2,101,655 | 12/1937 | Shields | 38/3 |
| 2,900,738 | 8/1959 | Offen | 34/60 |
| 3,393,463 | 7/1968 | Kemp | 38/56 |
| 3,413,915 | 12/1968 | Goodwin et al. | 100/210 |
| 3,725,639 | 4/1973 | Seil et al. | 100/93 RP |
| 3,740,867 | 6/1973 | Hamaguchi | 38/11 |

FOREIGN PATENTS OR APPLICATIONS

| | | | |
|---|---|---|---|
| 515,238 | 11/1939 | United Kingdom | 29/90.2 |
| 469,976 | 3/1914 | France | 34/60 |

*Primary Examiner*—Carroll B. Dority, Jr.
*Assistant Examiner*—Larry I. Schwartz

[57] ABSTRACT

An apparatus for improving the surface of a web of printing material for coating or printing including means to "drag" under pressure the web of material over a surface thereby flattening and aligning in a uniform pattern the fibers of a web of printing material.

12 Claims, 2 Drawing Figures

APPARATUS FOR IMPROVING PRINTING SURFACE OF PRINTING MATERIAL

CROSS REFERENCE TO RELATED APPLICATIONS

Figure 1:
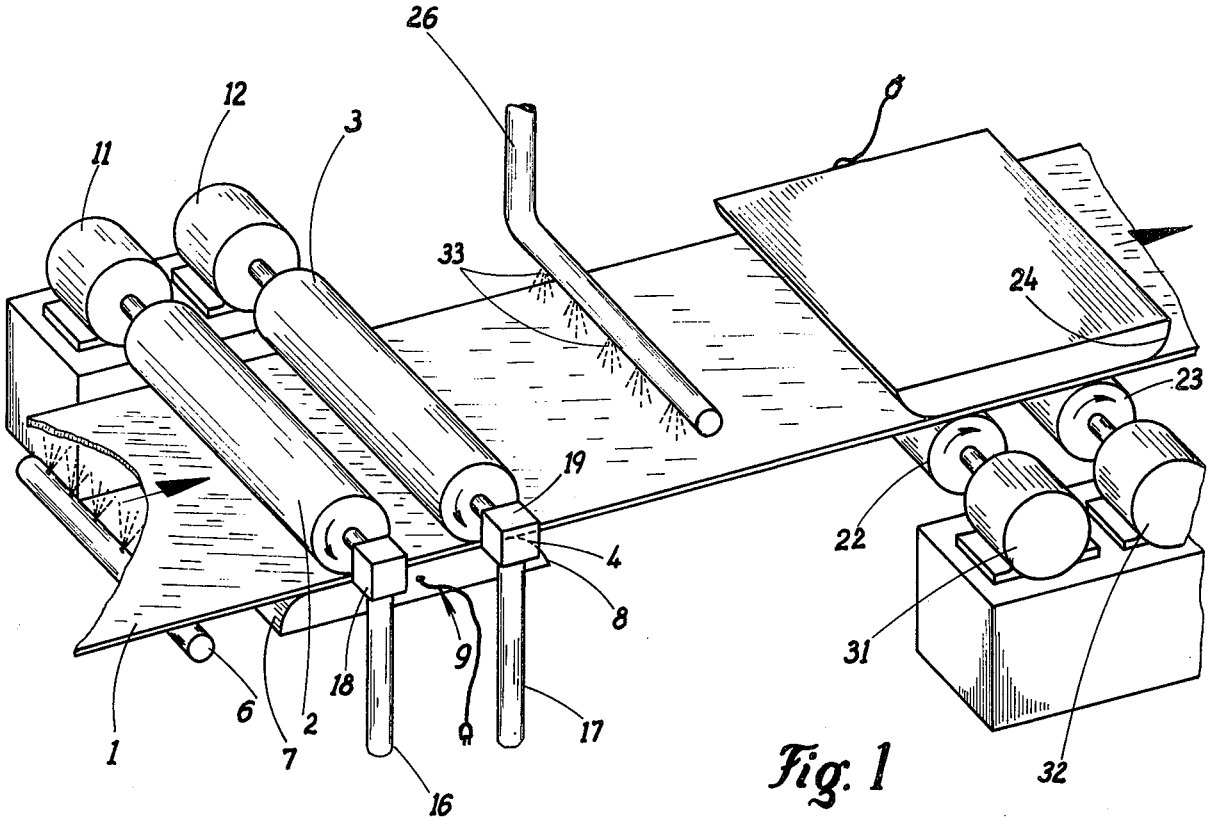

The present invention is a continuation-in-part of copending application Ser. No. 312,561, filed Dec. 6, 1972 now U.S. Pat. No. 3,826,016 by James K. Anderson.

BACKGROUND OF THE INVENTION

This invention relates to an apparatus for treating a web of material, and more particularly, relates to an apparatus for improving the surface of a web of material for coating or printing.

In the manufacture of material for printing, many different qualities of printing material are desired by the printing companies. In order to upgrade certain types of printing material to a smooth, glossy appearance, it is generally customary to take a web of rough, dull appearing material and subject the material to a plurality of pairs of pressure rolls. The pairs of pressure rolls are generally mounted so that each pair of rollers are adapted to receive a web of material therebetween, and pressing against each other, smooth out the rough portions of the material. Furthermore, the web of material is fed at a predetermined rate through the rollers and the rollers are adapted to rotate in the same direction as the moving web of material and at about the same rate of speed. Also, in some systems, steam means are utilized to moisten the printing material prior to entrance into the pressure rolling portion of the system in order to enhance the glossy appearance of the printing surface. However, it has been found that the aforementioned method of improving the printing surface of printing materials has proved to be expensive. Furthermore, an even better product, from a smoothness and appearance point of view, has been sought by the printing industry.

SUMMARY OF THE INVENTION

In the present invention, it is recognized that it is desirable to provide an apparatus for improving the surface of a web of printing material which is economical to manufacture and operate. It is further recognized that it is desirable to provide an apparatus for improving the surface of a sheet of printing material which is superior to the apparatuses presently available commercially. It is even further recognized that it is desirable to provide an apparatus for improving the surface of a sheet of printing material which may be utilized by printing companies to upgrade the quality of printing materials, in line with the printing operation.

The present invention advantageously provides a straightforward arrangement for an apparatus for improving the surface of a web of printing material. The present invention further provides for an apparatus for improving the surface of a web of printing material which is economical to manufacture, economical to operate, and requires a relatively small area.

Various other features of the present invention will become obvious to those skilled in the art upon reading the disclosure set forth hereinafter.

More particularly, the present invention provides an apparatus for improving the surface of a web of printing material comprising: a treating zone for continuously treating one surface of a web of printing material including at least one rotatably mounted roller and a treating surface, the rotatably mounted roller being disposed to contact the treating surface, the roller and treating surface being adapted to receive a web of material in contacting relationship therebetween under a preselected pressure with the surface of the web to be treated contacting the treating surface whereby the rotatably mounted roller rotates at a surface speed at least equal to the surface speed of the web material exerting a preselected pressure upon the web of material thereby dragging the material under pressure across the treating surface.

It is to be understood that the description of the examples of the present invention given hereinafter are not by way of limitation. Various modifications within the scope of the present invention will occur to those skilled in the art upon reading the disclosure set forth hereinafter.

Figure 2:
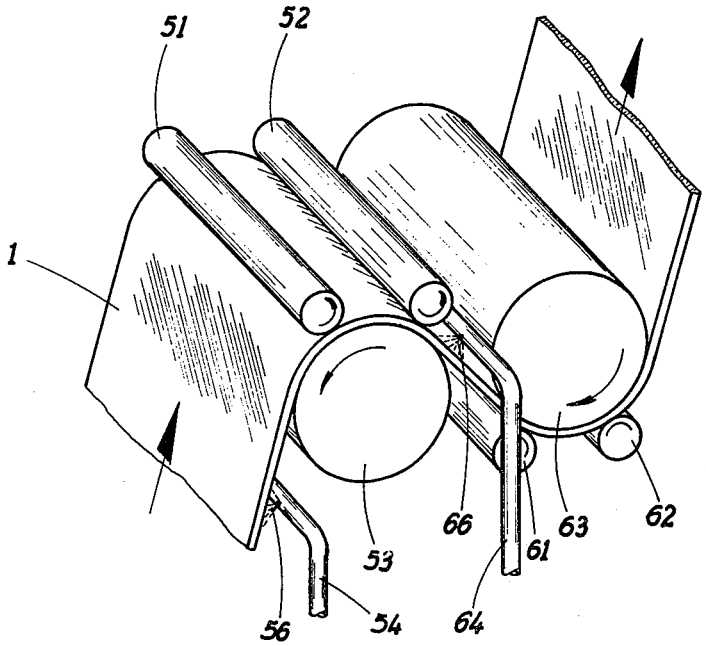

Referring to the drawing:

FIG. 1 is a perspective view illustrating a preferred embodiment of the apparatus of the present invention; and, FIG. 2 is a perspective view illustrating another preferred embodiment of the apparatus of the present invention.

Referring to FIG. 1, the apparatus for improving the surface of a sheet of printing material for coating or printing of the present invention includes two treating zones. The first treating zone is adapted to treat one side of a web of printing material and the second treating zone is adapted to treat the opposite side of the web of printing material.

The first treating zone includes at least one rotatably mounted cylinder on roller, two being shown in FIG. 1, identifiable as rollers 2 and 3, a treating surface 4 which includes heat means, and a steam conduit 6. The rollers 2 and 3 are pressure rolls mounted directly above the treating surface 4 and are adapted for contacting the surface 4 under a predetermined amount of pressure. Rollers 2 and 3 are generally constructed with a non-metallic surface. I have found that rollers having a surface of a hard silicon rubber or cotton work very well, as long as the surface material is adapted for operation at temperatures of up to 400°F. Also, rollers 2 and 3 are generally adapted to rotate in the same direction as the movement of a web of printing material with which they are in contact, but at a selected rotational speed such that the rollers will have a surface speed at least equal to or greater than the speed of the moving web material. Means for rotating the rollers may be by any conventional means, such as motors 11 and 12, motor 11 being for roller 2, and motor 12 being for roller 3. It is realized that only one motor may be necessary or the rollers may be connected through proper gearing to a motor drive which operates, for example, the feeding device for a printing machine. Various other means may be utilized for driving the pressure roller without departing from the scope of the present invention.

In the mounting of the pressure rollers 2 and 3, the rollers 2 and 3 are specifically mounted to exert a predetermined amount of pressure on the surface 4. Supports 16 and 17 with predetermined pressure exerting means 18 and 19, respectively, are provided to support and receive the rollers 2 and 3, whereby a uniform and preselected pressure may be applied to the rollers 2 and 3. The presssure exerting means may be hydraulic, air, spring, or any other conventional means for maintaining a preselected pressure on a given object. The amount of pressure exerted by the rollers will depend upon the type of material such as paper initially fed to the present device, the speed of the material between the pressure rollers and the treating surface, the speed of the material passing over the treating surface in relation to the surface speed of the treating surface, as well as pre-treatment of the material prior to entering the treating zone. For example, if the material, in this case paper, receives a pre-treatment, as herein described, the amount of pressure needed is less than for paper which has not been pre-treated at all. Furthermore, if the paper is traveling at relatively high rates of surface speed, the paper will be in the treating zone a shorter length of time than slower moving paper and it will be necessary to utilize a larger amount of pressure in the treating zone. However, it has been found that under no circumstances can the paper be improved if the pressure rolls exert less than 1 pound per square inch for pressure on the moving paper and generally requires at least 5 pounds per square inch. In the case of upgrading news-print type paper to rotogravure quality wherein the paper is traveling at a surface speed of generally from about 350 to 2,200 feet per minute, the pressure rollers must exert a pressure of at least 4 pounds per square inch and up to 200 pounds per square inch and higher.

The heated treating surface 4 may be substantially flat at the point of contact with each of the rollers, but the surface 4 is generally curved, as illustrated by the edges 7 and 8. Curving the entrance and exit portions of the heated treating surface 4 allows for web material traveling at a high rate of speed to enter and exit the treating zone with decreased opportunities for wrinkling. The heated treating surface 4 is generally maintained at a temperature of at least 150°F and usually less than 400°F, the temperature being such that moisture is removed from the paper without subjecting the paper to combustion temperatures. However, if moistening means, as described hereinafter, are not utilized, and, if the moisture content of the paper to be treated is less than 10 percent by weight, then heat is not necessary. The means for heating the surface 4 may be by any conventional means, such as electricity, gas, steam, and the like, the means for heating the heated surface 4 in FIG. 1 is electricity, as exemplified by the electrical cord 9.

Means for moistening the surface to be treated in the first treating zone is exemplified as a steam conduit 6 having a plurality of openings (not shown) therein, the conduit 6 extending transversely the width of the web of printing material 1, the conduit 6 being spaced from the web 1 with the openings (not shown) therein being evenly spaced to provide a uniform spray of steam across the surface of the material 1 as it passes across the steam conduit. It is realized that other moistening means, such as a water spray, may be used without departing from the scope and spirit of the present invention. It is even further realized that moistening means are not necessary for certain grades of paper having moisture contents greater than 5 percent by weight. But, in a preferred embodiment, it has been found that the addition of moisture just prior to treating provides for a better quality product leaving the treating zone.

The second treating zone of the exemplified apparatus in FIG. 1 is basically a mirror image of the first treating zone wherein the second treating zone is adapted to treat the opposite side of the sheet of printing material 1. The second treating zone includes a pair of rotatably mounted pressure rollers 22 and 23, a heated treating surface 24, and a steam conduit 26. The rollers 22 and 23 are constructed of the same material and are adapted to rotate at approximately the same speed as rollers 2 and 3. The rollers 22 and 23 are driven by motors 31 and 32, respectively, it being realized that other driving means may be utilized to turn the rollers 22 and 23. Rollers 22 and 23 are mounted so that they will press upwards towards the heated surface 24 at a predetermined pressure thereby keeping a uniform pressure on the web 1 as it passes through the treating zone.

The heated treating surface 24 is constructed and heated in the same manner as heated treating surface 4. The moistening means in the second treating zone is a steam conduit 26 having a plurality of openings 33 therein for spraying a uniform quantity of steam transversely of the surface of the sheet 1 which is to be treated.

FIG. 2 illustrates another preferred embodiment of the present invention including two treating zones, the first treating zone being adapted to treat one side of a web of printing material and the second treating zone being adapted to treat the opposite side of the web of printing material.

The first treating zone includes two rotatably mounted rollers 51 and 52, a heated treating surface 53, and a steam conduit 54. The rollers 51 and 52 are pressure rolls mounted directly above the heated surface 53 and are adapted for contacting the surface 53 under a predetermined amount of pressure. Rollers 51 and 52 are generally constructed with a non-metallic surface as discussed previously. Means for rotating the rollers 51 and 52 may be by any conventional means, such as motors (not shown). In the mounting of the pressure rollers 51 and 52, the rollers 51 and 52 are specifically mounted to exert a predetermined amount of pressure on the surface 53 in the same manner as discussed previously in relation to rollers 2 and 3.

The heated treating surface 53 in FIG. 2 is illustrated as a heated cylinder having a diameter substantially greater than the diameter of the pressure rollers 51 and 52. Means for heating the cylinder 53 is not shown but may be the same as described previously in the discussion of FIG. 1. The heated cylinder 53 is further adapted to rotate and is illustrated as rotating in the opposite direction in comparison with the rotation of the pressure rolls 51 and 52. The surface speed of cylinder 53 is relatively slow thereby "dragging" against the surface to be treated. It is realized that the cylinder 53 may be stationary or rotate in the same direction as the rollers 51 and 52, but at a relatively low surface speed. The heated surface 53 is generally maintained at a temperature of at least 150°F and usually less than 400°F. The means for heating the surface 53 may be by any conventional means, such as electricity, gas, steam, and the like, the means for heeating the heated surface not being shown.

Means for moistening the surface to be treated in the first treating zone is exemplified as a steam conduit 54 having a plurality of openings 56, only one being shown. The conduit 54 extends transversely the width of the sheet of printing material 1, the conduit 54 being spaced from the sheet 1 with the openings 56 therein being evenly spaced to provide a uniform spray of steam across the surface of the material 1 as it passes across the steam conduit 54.

The second treating zone of the exemplified apparatus in FIG. 2 is basically a mirror image of the first treating zone wherein the second treating zone is adapted to treat the opposite side of the sheet of printing material 1. The second treating zone includes a pair of rotatably mounted pressure rollers 61 and 62, a heated surface 63 and a steam conduit 64. The rollers 61 and 62 are constructed of the same material and are adapted to rotate at approximately the same speed as rollers 51 and 52. The rollers 61 and 62 are driven by, for example, motors (not shown), it being realized that other driving means may be utilized to turn the rollers 61 and 62. Rollers 61 and 62 are mounted so that they will press upwards towards the heated surface 63 at a predetermined pressure thereby keeping a uniform pressure on the web 1 as it passes through the treating zone.

The heated surface 63 is constructed and heated in the same manner as heated surface 53. The moistening means in the second treating zone is a steam conduit 64 having a plurality of openings 66 therein for spraying a uniform quantity of steam transversely of the surface of the web 1 which is to be treated.

In the operation of the apparatus of the example of the present invention, a web of printing material, such as a rough, dull appearing paper for upgrading is fed at a rate of up to 3,200 feet per minute from a feeding or unwinding machine (not shown) and higher to the first treating zone. As the web material 1 passes across the steam conduit, a uniform steam spray is applied across the entire width of the bottom surface of the web. The moistened web 1 then passes between the pressure rollers and the heated surface. For example, rollers 2 and 3 are adapted for exerting a pressure of about 1 to 200 pounds per square inch to the surface upon which they are in contact with the normal operating pressure range being from about 4 to 200 pounds per square inch. Rollers 2 and 3 have a surface speed of at least the speed of the moving web 1. The heated surface with which the sheet 1 comes in contact with is a metallic surface maintained at generally between 150° and 200°F. Between the pressure and movement of the pressure rollers in combination with the heated surface heating and "dragging" against the moistened surface of the web 1, the surface of the web 1 which contacts the heating surface is smooth and glossy.

The web 1 then passes under the steam conduit of the second treating zone wherein a uniform spray of steam is deposited transversely across the surface to be treated. The web 1 then passes between the second pair of pressure rollers and a second heated surface wherein the rollers are turning at a surface speed approximately equal to the surface speed of the pair of pressure rollers in treating zone 1, the second pair of rollers exerting an upward pressure of about the same as the first pair. The second heated surface is maintained at a temperature of about the same as the first heat surface. The web 1 leaving the second treating zone has printing surface on both surfaces of the sheet which are smooth and glossy in appearance. The web 1 is then fed to the printing or processing machine (not shown) or wound into coils for later use.

What is claimed is:

1. An apparatus for improving the surface of a continuously moving web of printing material in combination with a printing press, said apparatus being disposed at the feed end of said printing press and comprising: a first treating zone including: (1) at least one rotatably mounted pressure roller, (2) a first treating surface having a heat means as an integral part thereof and (3) a heating and moistening means prefacing said roller and treating surface, said rotatably mounted roller being disposed to contact said treating surface, said roller and treating surface being adapted to receive a web of material in contacting relationship therebetween under a preselected pressure with said surface of said web to be treated contacting said treating surface means rotating said roller at a surface speed at least equal to said surface speed of said web material and at a positive speed relative to said treating surface and exerting a preselected pressure upon said web of material thereby dragging said material under pressure across said treating surface.

2. The apparatus of claim 1 wherein said treating surface is stationarily mounted.

3. The apparatus of claim 1 wherein said treating surface is rotatably mounted.

4. The apparatus of claim 1 wherein said surface speed of said web of material is from about 200 feet per minute to about 2,200 feet per minute.

5. The apparatus of claim 1 wherein said preselected pressure is from about 4 pounds per square inch to about 200 pounds per square inch.

6. The apparatus of claim 1, wherein said first treating zone includes a second rotatably mounted pressure roller also being disposed to contact said treating surface and receiving said web of material in contacting relationship therebetween.

7. The apparatus of claim 1, said heat means maintains said treating surface at a temperature of from about 150°F to about 400°F.

8. The apparatus of claim 1 wherein said rotatably mounted presssure roller rotates at a surface speed greater than the surface speed of said web material thereby causing the nap on the surface of said web to be pointed in the direction of web travel as it passes thereunder.

9. The apparatus of claim 1 wherein said heating and moistening means is a steam conduit extending transversely the width of a web of material to be treated with apertures therein uniformly spaced to provide a uniform distribution of moisture across the entire width of the surface to be treated.

10. The apparatus of claim 1, including a second treating zone for treating the opposite surface of said web of printing material including (1) at least one rotatably mounted pressure roller, (2) a second treating surface having a heat means as an integral part thereof and, (3) a moistening means prefacing said rotatably mounted pressure roller and said second treating surface, said rotatably mounted roller being disposed to contact said second treating surface, said roller and second treating surface being adapted to receive said web of material in contacting relationship therebetween under a preselected pressure with said opposite surface of said web to be treated contacting said second treating surface whereby said rotatably mounted roller rotates at a surface speed at least equal to said surface speed of said web material exerting a preselected pressure upon said web of material thereby dragging said material under pressure across said treating surface.

11. The apparatus of claim 10 wherein the treating surface is rotatably mounted and rotates such that its relative velocity is opposite the movement of the material being treated.

12. The apparatus of claim 10 wherein the treating surface includes at least one portion thereon with a radius of curvature greater than the radius of curvature of said pressure roller.

* * * * *